US011127528B2

(12) United States Patent
Tsuduki et al.

(10) Patent No.: US 11,127,528 B2
(45) Date of Patent: Sep. 21, 2021

(54) COIL COMPONENT

(71) Applicant: Murata Manufacturing Co., Ltd., Kyoto-fu (JP)

(72) Inventors: Keiichi Tsuduki, Nagaokakyo (JP); Kouhei Matsuura, Nagaokakyo (JP); Hiroshi Ueki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 325 days.

(21) Appl. No.: 16/222,676

(22) Filed: Dec. 17, 2018

(65) Prior Publication Data

US 2019/0206612 A1 Jul. 4, 2019

(30) Foreign Application Priority Data

Dec. 28, 2017 (JP) ..... JP2017-253201

(51) Int. Cl.

| | |
|---|---|
| ***H01F 27/28*** | (2006.01) |
| ***H01F 27/29*** | (2006.01) |
| *H01F 41/10* | (2006.01) |
| *H01F 41/04* | (2006.01) |

(52) U.S. Cl.

CPC ..... *H01F 27/292* (2013.01); *H01F 27/28* (2013.01); *H01F 27/2804* (2013.01); *H01F 27/29* (2013.01); *H01F 41/043* (2013.01); *H01F 41/046* (2013.01); *H01F 41/10* (2013.01); *H01F 2027/2809* (2013.01)

(58) Field of Classification Search

CPC .. H01F 27/292; H01F 27/2804; H01F 41/046; H01F 41/043; H01F 2027/2809; H01F 41/10; H01F 27/29

See application file for complete search history.

(56) References Cited

FOREIGN PATENT DOCUMENTS

| | | | |
|---|---|---|---|
| JP | S58-135620 A | | 8/1983 |
| JP | 2002-208535 A | | 7/2002 |
| JP | 2005-005591 A | | 1/2005 |
| JP | 2005-191469 A | | 7/2005 |
| JP | 2008-279606 A | | 11/2008 |
| JP | 2016-146431 A | | 8/2016 |
| JP | 2016146431 A | * | 8/2016 |
| JP | 2017-073475 A | | 4/2017 |

OTHER PUBLICATIONS

An Office Action issued by the China National Intellectual Property Administration dated Oct. 12, 2020, which corresponds to Chinese Patent Application No. 201811510204.4 and is related to U.S. Appl. No. 16/222,676 with English language translation.

* cited by examiner

*Primary Examiner* — Tuyen T Nguyen

(74) *Attorney, Agent, or Firm* — Studebaker & Brackett PC

(57) ABSTRACT

A coil component includes a device main body composed of an insulator, a coil conductor which is disposed inside or on a surface of the device main body, and an outer electrode which is disposed on a surface of the device main body and electrically connected to the coil conductor. The outer electrode includes a Ag-containing layer containing Ag grains with an average grain size of 4.2 to 15 μm.

15 Claims, 6 Drawing Sheets

<SAMPLE NO. 31>

<SAMPLE NO. 33>

COIL COMPONENT

CROSS-REFERENCE TO RELATED APPLICATION

This application claims benefit of priority to Japanese Patent Application No. 2017-253201, filed Dec. 28, 2017, the entire content of which is incorporated herein by reference.

BACKGROUND

Technical Field

The present disclosure relates to a coil component which includes an outer electrode.

Background Art

A coil component, for example, includes a device main body having a coil conductor disposed therein or thereon, and an outer electrode disposed on the device main body so as to be electrically connected to the coil conductor.

Japanese Unexamined Patent Application Publication No. 2017-73475 describes a coil component including a multilayer body in which a non-magnetic material portion and magnetic material portions are stacked, outer electrodes containing Ag provided on both end faces of the multilayer body, and two coil conductors disposed in the non-magnetic material portion. Furthermore, Japanese Unexamined Patent Application Publication No. 2005-5591 describes a coil component including outer electrodes containing Ag. In the coil component, the outer electrodes are formed by using a conductive paste which contains silver powder with an average grain size of 0.5 to 0.9 μm, a glass frit, and an organic vehicle. Japanese Unexamined Patent Application Publication No. 2005-5591 describes that, by using such a composition, it is possible to form thick outer electrodes that are dense and have low porosity, and it is possible to provide a highly reliable coil component.

When the outer electrodes described in Japanese Unexamined Patent Application Publication No. 2005-5591 are applied to the coil component described in Japanese Unexamined Patent Application Publication No. 2017-73475, it is possible to obtain a coil component having thick outer electrodes that are dense and have low porosity. However, there is a possibility that the potential difference between the two coil conductors will cause electrochemical migration of Ag contained in the outer electrodes, leading to a short circuit between the outer electrodes.

In particular, when coil components are reduced in size and the distance between outer electrodes decreases, electrochemical migration of Ag becomes likely to occur.

SUMMARY

Accordingly, the present disclosure provides a coil component capable of suppressing occurrence of electrochemical migration of Ag contained in outer electrodes.

According to preferred embodiments of the present disclosure, a coil component includes a device main body composed of an insulator, a coil conductor which is disposed inside or on a surface of the device main body, and an outer electrode which is disposed on a surface of the device main body and electrically connected to the coil conductor. The outer electrode includes a Ag-containing layer containing Ag grains with an average grain size of 4.2 μm to 15 μm.

The ratio of grain boundary length to area of the Ag grain contained in the Ag-containing layer may be 1.1 or less. Furthermore, the outer electrode may further include a plating layer disposed on the Ag-containing layer, and the plating layer may have a thickness of 3.6 μm to 20 μm. The plating layer may include a Ni layer containing Ni and a Sn layer containing Sn and formed on the Ni layer, and the Ni layer may have a thickness of 3 μm or more.

The device main body may be a multilayer body in which a plurality of insulating layers are stacked, and the coil conductor may be configured to include planar conductors disposed on the insulating layers, and an interlayer conductor that joins the planar conductors disposed on different insulating layers. The insulating layers may include a magnetic material layer mainly composed of ferrite and a glass-ceramic layer, and the coil conductor may be disposed inside the glass-ceramic layer.

The Ag-containing layer may contain 0.5% to 2% by weight of a glass phase containing at least one of Bi, Si, Zn, and B. The Ag-containing layer may have a pore area ratio of 8.3% or less.

In the coil component according to preferred embodiments of the present disclosure, since the average grain size of Ag grains contained in the outer electrode is 4.2 μm to 15 μm, grain boundaries of Ag grains are reduced, and thus Ag ionization reaction can be suppressed. Therefore, occurrence of electrochemical migration of Ag can be suppressed, and a short circuit between outer electrodes due to electrochemical migration of Ag can be suppressed.

Other features, elements, characteristics and advantages of the present disclosure will become more apparent from the following detailed description of preferred embodiments of the present disclosure with reference to the attached drawings.

DETAILED DESCRIPTION

Preferred embodiments of the present disclosure will be described below to explain characteristics of the present disclosure specifically.

First Embodiment

Figure 1:
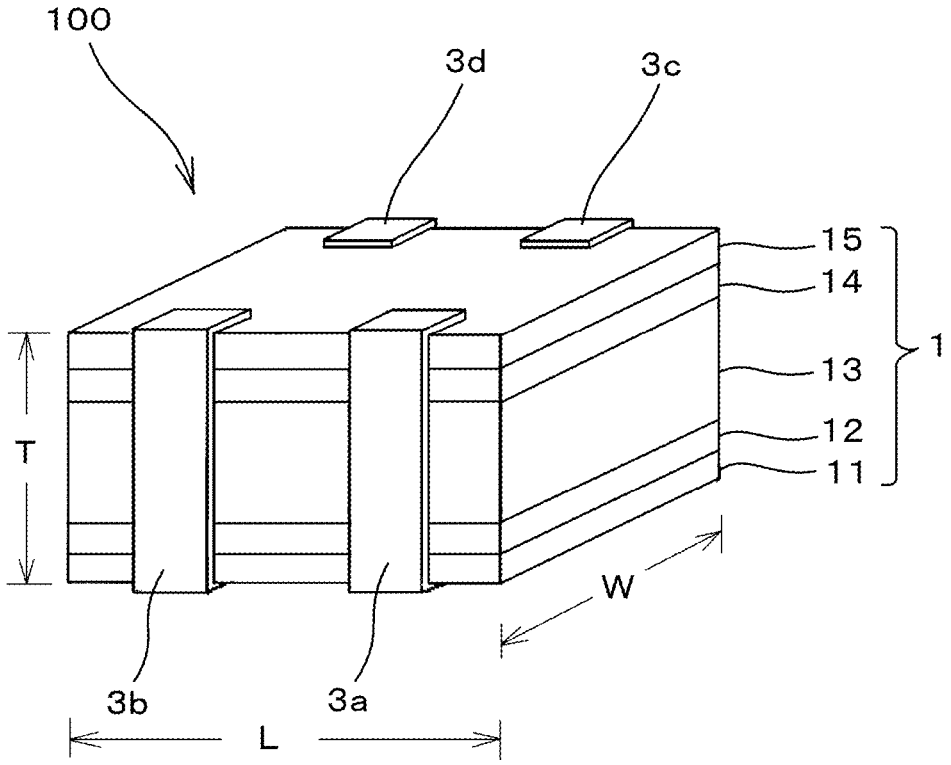
FIG. 1 is a view showing an appearance of a coil component according to a first embodiment.
Figure 2:
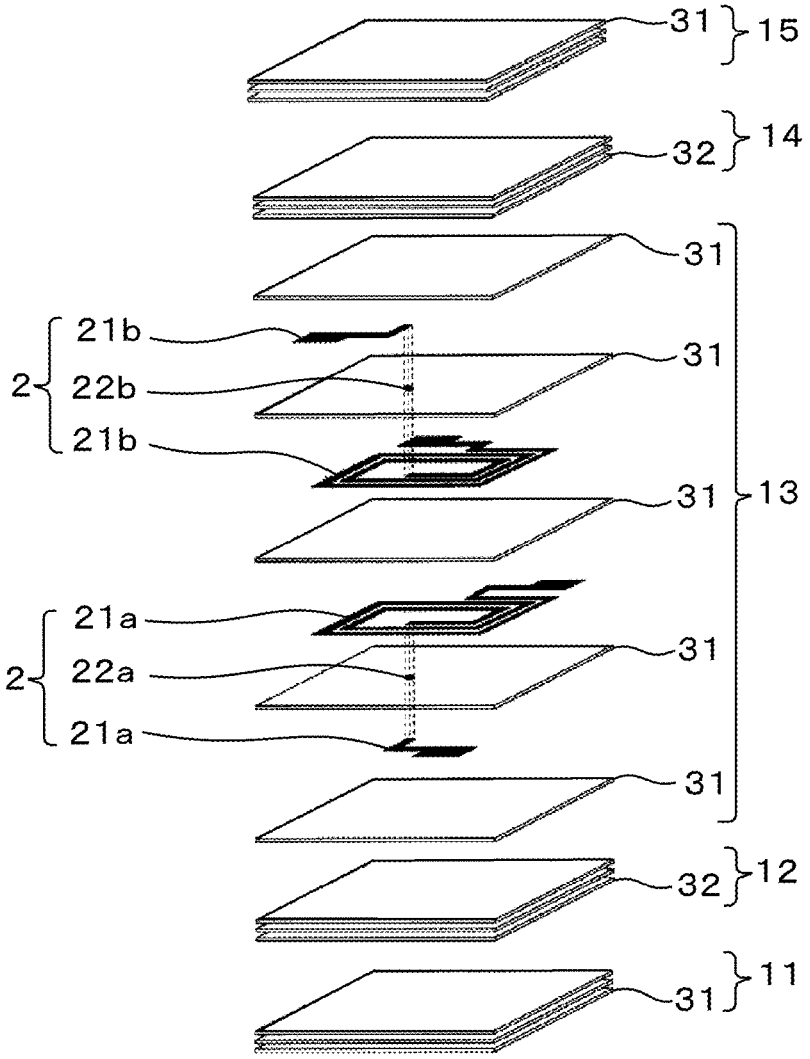
FIG. 2 is an exploded view of the coil component.

FIG. 1 is a view showing an appearance of a coil component 100 according to a first embodiment, and FIG. 2 is an exploded view of the coil component 100. In FIG. 2, outer electrodes 3*a*, 3*b*, 3*c*, and 3*d* constituting the coil component 100 are omitted.

The coil component 100 includes a device main body 1 composed of an insulator, coil conductors 2 disposed inside the device main body 1, and outer electrodes 3*a*, 3*b*, 3*c*, and 3*d* which are disposed on a surface of the device main body 1 and electrically connected to the coil conductors 2.

In the following description, the outer electrodes 3*a*, 3*b*, 3*c*, and 3*d* are referred to as the "outer electrode 3" when describing without distinction.

The device main body 1 is a multilayer body in which a plurality of glass-ceramic layers and magnetic material layers are stacked. In this embodiment, the device main body 1 has a structure in which a first glass-ceramic layer 11, a first magnetic material layer 12, a second glass-ceramic layer 13, a second magnetic material layer 14, and a third glass-ceramic layer 15 are stacked in this order.

The first glass-ceramic layer 11, the second glass-ceramic layer 13, and the third glass-ceramic layer 15 each have a structure in which a plurality of glass-ceramic sheets 31 are stacked. The first magnetic material layer 12 and the second magnetic material layer 14 each have a structure in which a plurality of magnetic material sheets 32 mainly composed of ferrite are stacked.

A glass-ceramic sheet 31 and a magnetic material sheet 32 each constitute an insulating layer. Therefore, the device main body 1 can be considered to be a multilayer body in which a plurality of insulating layers are stacked.

The coil conductors 2 are disposed inside the device main body 1, more specifically, inside the second glass-ceramic layer 13. The coil conductors 2 include planar conductors 21*a* disposed on glass-ceramic sheets 31 constituting the second glass-ceramic layer 13 and an interlayer conductor 22*a* that joins the planar conductors 21*a* disposed on different glass-ceramic sheets 31, and include planar conductors 21*b* disposed on glass-ceramic sheets 31 constituting the second glass-ceramic layer 13 and an interlayer conductor 22*b* that joins the planar conductors 21*b* disposed on different glass-ceramic sheets 31.

In this embodiment, the outer electrodes 3*a*, 3*b*, 3*c*, and 3*d* are disposed at four positions on the surface of the device main body 1. The outer electrode 3*a* is opposed to the outer electrode 3*c*, and the outer electrode 3*b* is opposed to the outer electrode 3*d*.

The outer electrode 3*a* is connected to one end of a planar conductor 21*a* constituting the coil conductor 2, and the outer electrode 3*c* is connected to the other end of the planar conductor 21*a*. Furthermore, the outer electrode 3*b* is connected to one end of a planar conductor 21*b* constituting the coil conductor 2, and the outer electrode 3*d* is connected to the other end of the planar conductor 21*b*.

The outer electrode 3 includes a Ag-containing layer containing Ag grains with an average grain size of 4.2 to 15 μm. Since the average grain size of Ag grains contained in the outer electrode 3 is 4.2 to 15 μm, grain boundaries of Ag grains are reduced, and thus Ag ionization reaction can be suppressed. Therefore, occurrence of electrochemical migration of Ag can be suppressed, and a short circuit between outer electrodes due to electrochemical migration of Ag can be suppressed.

In particular, in an existing coil component including four or more outer electrodes, since the distance between outer electrodes is decreased, electrochemical migration of Ag is likely to occur. However, by using the configuration of the coil component 100 according to this embodiment, electrochemical migration can be effectively suppressed.

Preferably, the ratio of grain boundary length to area of the Ag grain contained in the Ag-containing layer constituting the outer electrode 3 is 1.1 or less. By using such a configuration, since grain boundaries of Ag grains are reduced, Ag ionization can be suppressed, and occurrence of electrochemical migration can be suppressed.

Preferably, the Ag-containing layer constituting the outer electrode 3 contains 0.5% to 2% by weight of a glass phase containing at least one of Bi, Si, Zn, and B. However, the composition of the Ag-containing layer is not limited thereto.

Preferably, the Ag-containing layer has a pore area ratio of 8.3% or less. The details of the pore area ratio will be described later. By setting the pore area ratio of the Ag-containing layer to be 8.3% or less, penetration of moisture into the outer electrode 3 can be suppressed, and the effect of suppressing electrochemical migration can be enhanced.

Second Embodiment

The coil component 100 according to the first embodiment includes two coil conductors 2 disposed inside the device main body 1 and four outer electrodes 3 electrically connected to the coil conductors 2. In contrast, a coil component according to a second embodiment includes one coil conductor disposed inside a device main body 1 and two outer electrodes 3 electrically connected to the coil conductor.

Figure 3:
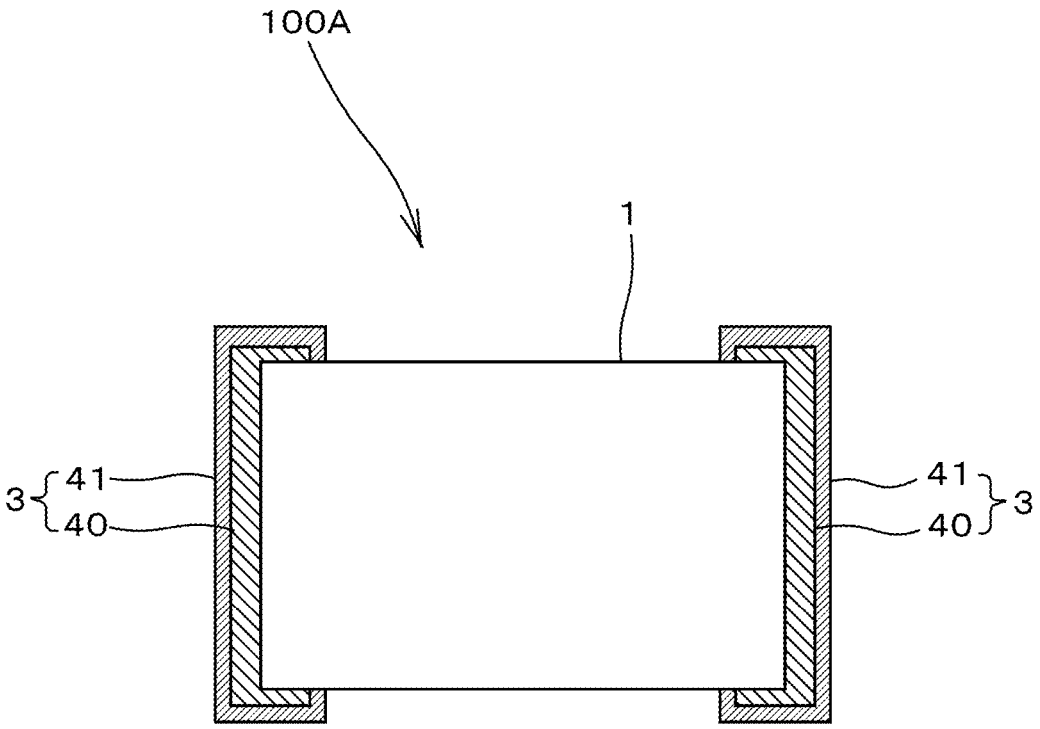
FIG. 3 is a cross-sectional view of a coil component according to a second embodiment, taken such that cross-sectional shapes of a pair of opposing outer electrodes are exposed.

FIG. 3 is a cross-sectional view of a coil component 100A according to the second embodiment, taken such that cross-sectional shapes of a pair of opposing outer electrodes 3 are exposed. The pair of opposing outer electrodes 3 are electrically connected to a coil conductor 2 disposed inside the device main body 1. However, in FIG. 3, the coil conductor 2 disposed inside the device main body 1 is omitted.

A plating layer 41 is formed so as to cover a Ag-containing layer 40. The composition of the Ag-containing layer 40 is the same as that of the outer electrode 3 of the coil component 100 according to the first embodiment.

Preferably, the plating layer 41 has a thickness of 3.6 μm to 20 μm. By setting the thickness of the plating layer 41 to be 3.6 μm or more, penetration of moisture into the outer electrode 3 can be further suppressed, and the effect of suppressing electrochemical migration can be further enhanced. Furthermore, by setting the thickness of the plating layer 41 to be 20 μm or less, plating peeling can be suppressed. However, the thickness of the plating layer 41 may be less than 3.6 μm and may be more than 20 μm.

The plating layer 41 may include one layer or two or more layers. In the case where the plating layer 41 includes two or more layers, the plating layer 41 can include a Ni layer containing Ni and a Sn layer containing Sn and formed on the Ni layer. In this case, preferably, the Ni layer has a thickness of 3 μm or more. By setting the thickness of the Ni layer to be 3 μm or more, pinholes in the Ni layer can be reduced, and the Ni layer can function as a good barrier layer.

The plating layer 41 may be formed by electroplating or by electroless plating. As described above, since the plating layer 41 is disposed so as to cover the Ag-containing layer 40, by protecting the surface of the outer electrode 3, penetration of moisture from the outside can be suppressed, and occurrence of electrochemical migration can be suppressed. Furthermore, it is possible to prevent erosion of solder when the coil component 100A is mounted by soldering.

Example 1

[Formation of Magnetic Material Layer]

As a material for forming a magnetic material layer, preferably, a Zn—Cu—Ni-based ferrite material is used.

Here, raw material powders of $Fe_2O_3$, ZnO, CuO, and NiO were weighed so as to satisfy a predetermined molar ratio. The weighed materials were placed in a pot mill, together with pure water and media, such as partially stabilized zirconia (PSZ) balls, and by performing wet mixing and pulverization, a slurry was obtained. The resulting slurry was discharged and dried by evaporation, and then calcination was performed at a temperature of 700° C. to 800° C., to thereby obtain a calcined powder.

An organic binder and an organic solvent were added to the calcined powder, the mixture was placed in a pot mill together with media, such as PSZ balls, and by performing mixing and pulverization, a magnetic material slurry was obtained. The resulting magnetic material slurry was formed into a sheet by using a doctor blade method, and thereby, a magnetic material sheet constituting a magnetic material layer was obtained. The thickness of the magnetic material sheet was about 30 μm.

The raw material powders of $Fe_2O_3$, ZnO, CuO, and NiO described above are preferably mixed to form a composition including 40 mol % to 49.5 mol % of $Fe_2O_3$, 5 mol % to 35 mol % of ZnO, and 4 mol % to 12 mol % of CuO, with the balance being NiO and minute amounts of additives. The minute amounts of additives include unavoidable impurities.

[Formation of Glass-Ceramic Layer]

A borosilicate glass powder composed of predetermined amounts of Si, B, and K, a predetermined amount of quartz serving as a filler, an alumina powder, an organic binder, and an organic solvent were prepared, and these materials were placed in a pot mill together with media, such as PSZ balls. By performing mixing and pulverization, a glass-ceramic slurry was obtained. The resulting glass-ceramic slurry was formed into a sheet by using a doctor blade method, and thereby, a glass-ceramic sheet constituting a glass-ceramic layer was obtained. The thickness of the glass-ceramic sheet was about 30 μm.

As described above, the glass-ceramic layer is preferably composed of borosilicate glass and a filler. Since the borosilicate glass has a low relative permittivity, the resulting coil component can exhibit good high-frequency characteristics.

The composition of the borosilicate glass includes, for example, 70% to 85% by weight of $SiO_2$, 10% to 25% by weight of $B_2O_3$, 0.5% to 5% by weight of $K_2O$, and 0% to 5% by weight of $Al_2O_3$. As the filler, besides the quarts ($SiO_2$) described above, forsterite ($2MgO.SiO_2$), alumina ($Al_2O_3$), or the like can be used. The filler content is preferably 2% to 30% by weight.

Since the relative permittivity of quarts is lower than that of borosilicate glass, by using quartz as a filler, the resulting coil component can exhibit better high-frequency characteristics. Furthermore, since forsterite and alumina have high flexural strength, by using forsterite or alumina as the filler, the mechanical strength of the resulting coil component can be increased.

[Fabrication of Coil Component]

A conductive paste mainly composed of Ag was prepared, and by applying the conductive paste by screen printing to the glass-ceramic sheet, patterns serving as coil conductors were formed. The coil conductors include extended electrodes to be connected to outer electrodes. Then, via holes were formed by irradiating predetermined points with a laser, and the via holes were filled with the conductive paste. Portions where via holes were filled with the conductive paste serve as interlayer conductors 22*a* and 22*b* when a coil component 100 is fabricated.

Subsequently, in the stacking order shown in FIG. 2, glass-ceramic sheets, magnetic material sheets, and glass-ceramic sheets on which the conductive paste had been applied were stacked, followed by heating and pressure bonding, and thereby, a multilayer formed body was obtained.

Subsequently, the resulting multilayer formed body was placed in a sagger, and a debinding process was carried out in the air atmosphere at a temperature of 350° C. to 500° C. Then, a firing process was carried out at 900° C. for two hours to thereby obtain a device main body having coil conductors disposed therein.

Subsequently, a conductive paste for outer electrodes containing Ag and a glass frit was applied to the surface of the device main body at predetermined four positions. As the glass frit, a Bi—Si-based glass frit was used, and the content thereof was set to be 1% by weight relative to the total of Ag powder and the glass frit.

Subsequently, the device main body to which the conductive paste for outer electrodes had been applied was baked at a temperature of 750° C. to 900° C. Thereby, a coil component provided with outer electrodes was produced. Here, by baking at different baking temperatures in the range of 750° C. to 900° C., 11 samples having different average grain sizes of Ag grains contained in the outer electrodes were produced. For example, when the baking temperature was set at 830° C. or higher, samples having an average Ag grain size of 3.6 μm or more were obtained.

Furthermore, when 11 samples were produced, at a baking temperature of 200° C. to 500° C., by raising the temperature at different temperature raising rates in the range of 20° C./min to 400° C./min, the pore area ratio was changed. For example, by setting the temperature raising rate at 200° C./min or less, samples with a pore area ratio of 8.3% or less were obtained.

Regarding the size of the samples produced, the dimension L in the longitudinal direction was 0.85 mm, the dimension W in the width direction was 0.65 mm, and the dimension T in the thickness direction was 0.45 mm.

Table 1 shows characteristics of the 11 samples. In Table 1, the samples of Sample Nos. 1 to 3 and No. 11, which are marked with * are reference samples which do not satisfy the requirement of the present disclosure, i.e., the average grain size of Ag grains contained in the Ag-containing layer constituting the outer electrode is 4.2 μm to 15 μm.

TABLE 1

| Sample No. | Average Ag grain size (μm) | Ratio of grain boundary length to area of Ag grain (/μm) | Pore area ratio (%) | Occurrence or nonoccurrence of edge breakage | Distance of extension due to electrochemical migration |
|---|---|---|---|---|---|
| *1 | 1.5 | 3.2 | 3.8 | ○ | 250 |
| *2 | 2.2 | 2.2 | 4.3 | ○ | 250 |
| *3 | 3.3 | 1.5 | 3.2 | ○ | 250 |
| 4 | 4.2 | 1.1 | 1.1 | ○ | 48.2 |
| 5 | 5.6 | 0.9 | 8.3 | ○ | 63.2 |
| 6 | 5.7 | 0.8 | 3.6 | ○ | 23.4 |
| 7 | 5.8 | 0.8 | 0.8 | ○ | 15.8 |
| 8 | 7.2 | 0.7 | 0.5 | ○ | 5.8 |
| 9 | 10.6 | 0.5 | 0.2 | ○ | 4.9 |
| 10 | 15.0 | 0.3 | 0.3 | ○ | 4.2 |
| *11 | 18.2 | 0.3 | 0.2 | X | 4.8 |

As shown in Table 1, regarding samples of Sample Nos. 1 to 11, the average Ag grain size, the ratio of grain boundary length to area of the Ag grain, the pore area ratio, the occurrence or nonoccurrence of edge breakage, and the distance of extension due to electrochemical migration were investigated.

(Average Ag Grain Size)

Each sample was put in a vertically standing position, and the circumference of the sample was solidified with a resin. Then, an LT plane extending in the length and thickness directions of the sample was ground with a grinder, and thereby, a section near the center of the outer electrode was exposed. The exposed section was subjected to ion milling to remove sags due to grinding.

Next, the substantially central part of the outer electrode was subjected to focused ion beam machining to thereby obtain a section for observation. The section for observation was photographed at a magnification of 1,000 to 2,000 times by using a scanning electron microscope (SEM), and by analyzing the resulting photograph, the equivalent circle diameter of the Ag grain was obtained. The equivalent circle diameter of the Ag grain is defined as the diameter of a perfect circle obtained on the basis of an area of the Ag grain. The photograph can be analyzed, for example, by using image analysis software, such as "A-ZO KUN (registered trademark)" manufactured by Asahi Kasei Engineering Corporation.

By the method described above, equivalent circle diameters of 50 or more Ag grains were obtained, and the average value thereof was considered as the average Ag grain size for each sample. However, in the case where it was not possible to obtain equivalent circle diameters of 50 Ag grains in observation of one sample, by observing another sample produced under the same conditions, equivalent circle diameters of 50 or more Ag grains were obtained.

(Ratio of Grain Boundary Length to Area of Ag Grain)

By analyzing the photograph of the section for observation obtained by the method described above, the grain boundary length and the area of the Ag grain were obtained, and the ratio of grain boundary length to area of the Ag grain was obtained. The area of the Ag grain is a projected area of the Ag grain. Here, regarding 50 or more Ag grains, the ratio of grain boundary length to area was obtained, and the average value thereof was defined as the "ratio of grain boundary length to area of the Ag grain" for each sample.

(Pore Area Ratio)

By analyzing the photograph of the section for observation obtained by the method described above, the area of the portion where Ag grains were present and the area of pores were obtained. The ratio of the area of pores to the total of the area of the portion where Ag grains were present and the area of pores was calculated and defined as the pore area ratio. The pore area ratio was obtained by using one sample, from one field of view.

(Edge Breakage)

Regarding the samples produced, occurrence or nonoccurrence of edge breakage, in which the outer electrode was not formed on the edge portion of the region in which the outer electrode was to be formed, was checked. Here, regarding each of the samples of Sample Nos. 1 to 11, the appearance was observed on 30 test pieces. The case where there were no test pieces in which edge breakage occurred was evaluated as "○", and the case where there was at least one test piece in which edge breakage occurred was evaluated as "x".

(Distance of Extension Due to Electrochemical Migration)

Each of the samples produced was mounted by soldering on a substrate having lands, and a humidity load test was performed, in which, under conditions of 85° C. and 85% RH, a DC voltage of 5 V was applied between the outer electrode 3*a* and the outer electrode 3*c* and between the outer electrode 3*b* and the outer electrode 3*d*. After 100 hours elapsed, the sample was taken out, and the distance of extension due to Ag electrochemical migration was measured with an optical microscope. Here, regarding each of the samples of Sample Nos. 1 to 11, the distance of extension was measured on five test pieces, and the average value thereof was obtained.

As shown in Table 1, in the samples of Sample Nos. 1 to 3 in which the average grain size of Ag grains contained in the outer electrode is less than 4.2 μm and which do not satisfy the requirement of the present disclosure, the distance of extension due to Ag electrochemical migration is 250 μm. Furthermore, in the sample of Sample No. 11 in which the average grain size of Ag grains contained in the outer electrode is 18.2 μm and which does not satisfy the requirement of the present disclosure, although the distance of extension due to Ag electrochemical migration is 4.8 μm, edge breakage of the outer electrode occurs.

In contrast, in the samples of Sample Nos. 4 to 10 which satisfy the requirement of the present disclosure, i.e., the average grain size of Ag grains contained in the outer electrode is 4.2 μm to 15 μm, the distance of extension due to Ag electrochemical migration is 63.2 μm or less, and electrochemical migration is suppressed. Furthermore, edge breakage of the outer electrode does not occur.

As shown in Table 1, in the samples of Sample Nos. 4 to 10 which satisfy the requirement of the present disclosure, the ratio of grain boundary length to area of the Ag grain is 1.1 or less. That is, by setting the average grain size of Ag grains contained in the outer electrode to be 4.2 μm or more, grain boundaries of Ag grains are reduced. Therefore, Ag ionization reaction is suppressed, and electrochemical migration is suppressed. Furthermore, by setting the average Ag grain size to be 15 μm or less, occurrence of edge breakage can be suppressed.

Example 2

On the basis of the sample of Sample No. 4 produced in Example 1, samples in which a plating layer was formed on the Ag-containing layer of the outer electrode were produced. Here, as shown in Table 2, seven samples (Sample Nos. 21 to 27) including plating layers formed of different metals with different thicknesses were produced.

TABLE 2

| Sample No. | Thickness of Ni plating (μm) | Thickness of Cu plating (μm) | Thickness of Sn plating (μm) | Total thickness of plating (μm) | Distance of extension due to electrochemical migration (μm) | Occurrence or nonoccurrence of plating peeling |
|---|---|---|---|---|---|---|
| 4 | — | — | — | — | 48.2 | — |
| 21 | 0.8 | — | 0.9 | 1.7 | 47.1 | ○ |
| 22 | 1.9 | — | 1.7 | 3.6 | 0 | ○ |
| 23 | — | 2.6 | 1.7 | 4.3 | 0 | ○ |
| 24 | — | 3.3 | 2.2 | 5.5 | 0 | ○ |
| 25 | 7 | — | 7 | 14 | 0 | ○ |
| 26 | 11 | — | 9 | 20 | 0 | ○ |
| 27 | 13 | — | 12 | 25 | 32.1 | X |

Table 2 shows, regarding the samples of Sample Nos. 21 to 27 and the sample of Sample No. 4 which does not include a plating layer, the thickness of the plating layer, the distance of extension due to electrochemical migration, and the occurrence or nonoccurrence of plating peeling.

(Thickness of Plating Layer)

The thickness of the plating layer was obtained by the method described below. First, by the same method as that explained in Example 1, an LT plane of the sample was ground to expose a section near the center of the outer electrode, and the exposed section was subjected to ion milling to remove sags due to grinding. Then, the exposed section was observed by using an optical microscope, and the thickness of the plating layer was measured. Here, regarding each of the samples of Sample Nos. 21 to 27, the thickness of the plating layer was measured on ten test pieces, and the average value thereof was obtained.

(Distance of Extension Due to Electrochemical Migration)

The distance of extension due to electrochemical migration was obtained by the method explained in Example 1.

(Plating Peeling)

Regarding each of the samples of Sample Nos. 21 to 27, the appearance was observed on 30 test pieces. The case where there was at least one test piece in which plating did not adhere to the Ag-containing layer was evaluated as "x", and the case where plating adhered to all the test pieces was evaluated as "○".

As shown in Table 2, in the samples of Sample Nos. 21 to 26 in which the plating layer is formed on the Ag-containing layer, the distance of extension due to electrochemical migration is shorter than that of the sample of Sample No. 4 which does not include a plating layer. In particular, in the samples of Sample Nos. 22 to 26 in which the total thickness of the plating layer is 3.6 μm to 20 μm, the distance of extension due to electrochemical migration is 0.

On the other hand, in the sample of Sample No. 27 in which the total thickness of the plating layer is 25 μm, plating peeling occurs, and the distance of extension due to electrochemical migration is 32.1 μm.

That is, by forming a plating layer with a thickness of 3.6 μm to 20 μm on the Ag-containing layer, the surface of the outer electrode is protected. Thus, penetration of moisture from the outside can be suppressed, and occurrence of electrochemical migration can be suppressed.

Example 3

Figure 4:
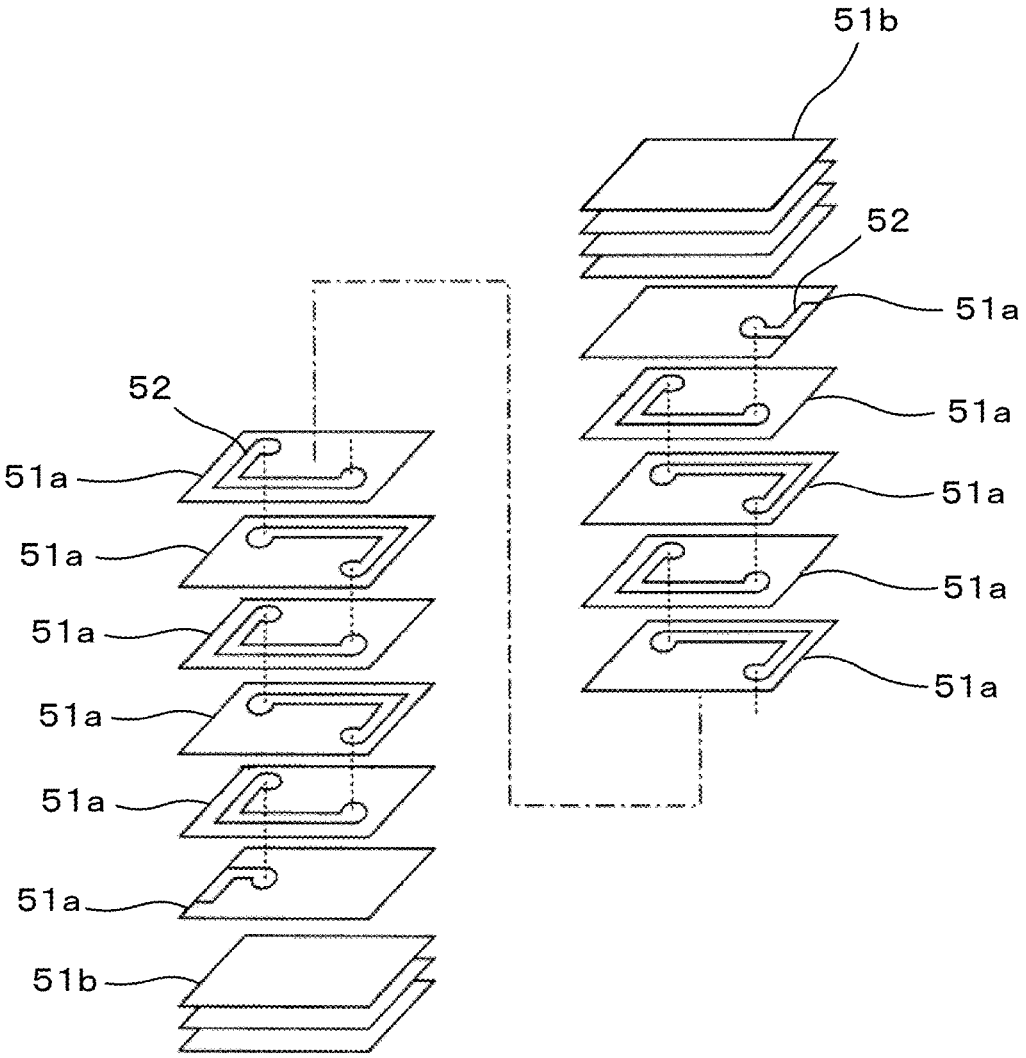
FIG. 4 is a view showing a multilayered structure including magnetic material sheets on which a conductive paste is applied and magnetic material sheets on which a conductive paste is not applied.

With reference to FIG. 4, a method of fabricating a coil component in Example 3 will be described.

A magnetic material sheet 51, which is described in Example 1, was formed. A conductive paste 52 mainly composed of Ag was applied by screen printing to the magnetic material sheet 51, and thereby, a pattern serving as a coil conductor was formed. Then, via holes were formed by irradiating predetermined points with a laser, and the via holes were filled with the conductive paste.

Subsequently, in the stacking order shown in FIG. 4, magnetic material sheets 51*a* on which the conductive paste 52 had been applied and magnetic material sheets 51*b* on which no conductive paste had been applied were stacked, followed by heating and pressure bonding, and thereby, a multilayer formed body was obtained.

Subsequently, the resulting multilayer formed body was placed in a sagger, and a debinding process was carried out in the air atmosphere at a temperature of 350° C. to 500° C. Then, a firing process was carried out at 900° C. for two hours to thereby obtain a device main body having a coil conductor disposed therein.

Subsequently, a conductive paste for outer electrodes containing Ag and a glass frit was applied to both end faces of the device main body, followed by baking at a temperature of 850° C. Here, the conductive paste for outer electrodes contained 1% by weight of a Zn-based glass frit.

Subsequently, a Sn plating layer with a thickness of 1 μm was formed by electroplating on the Ag-containing layer formed by baking, and thereby, a coil component was fabricated. The coil component fabricated by the method described above was used as a sample of Sample No. 31.

Regarding the size of the sample produced, the dimension L in the longitudinal direction was 1.6 mm, the dimension W in the width direction was 0.8 mm, and the dimension T in the thickness direction was 0.6 mm.

Figure 5:
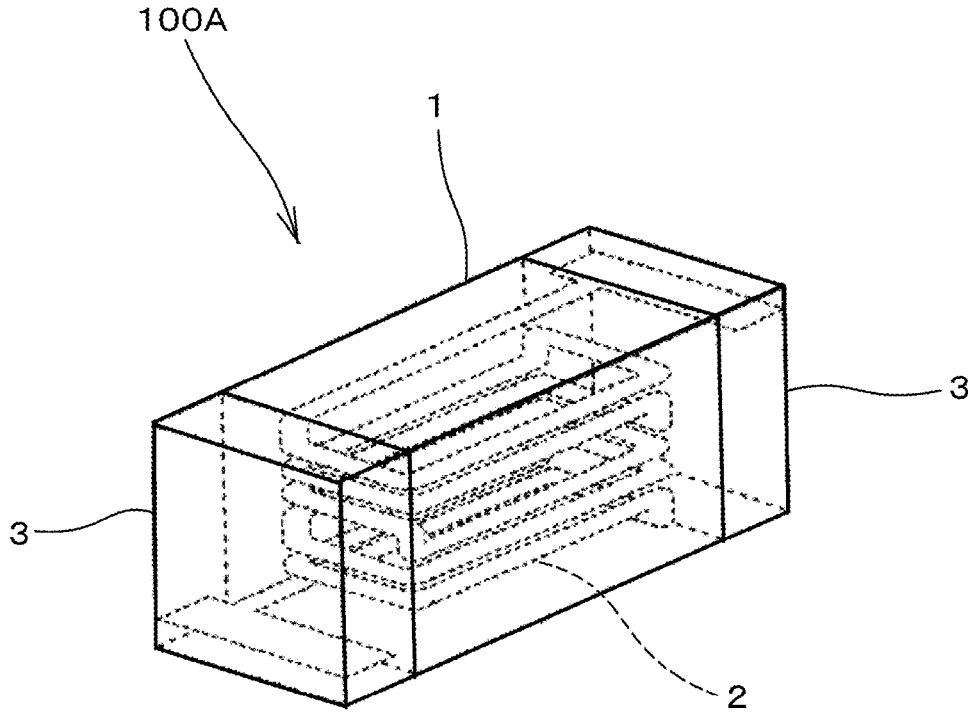
FIG. 5 is a view showing a coil component fabricated in Example 3.

FIG. 5 is a view showing a coil component 100A fabricated by the method described above. A coil conductor 2 is disposed inside a device main body 1. Furthermore, outer electrodes 3 are disposed on both end faces of the device main body 1. As described above, the outer electrode 3 includes the Ag-containing layer and the plating layer.

Furthermore, a coil component, in which a Ni plating layer with a thickness of 3 μm was formed, and a Sn plating layer with a thickness of 1 μm was formed on the Ni plating layer during the plating treatment, was also fabricated and used as a sample of Sample No. 32.

Furthermore, a coil component fabricated under the same conditions as those of the sample of Sample No. 31 except that the baking temperature was set at 660° C. instead of 850° C. was used as a sample of Sample No. 33.

Furthermore, a coil component fabricated under the same conditions as those of the sample of Sample No. 32 except that the baking temperature was set at 660° C. instead of 850° C. was used as a sample of Sample No. 34.

(Evaluation of Samples)

Regarding the samples of Sample Nos. 31 to 34, the average grain size of Ag grains contained in the outer electrode was obtained by the method explained in Example 1. Table 3 shows the average Ag grain size of the samples of Sample Nos. 32 and 34. Note that the samples of Sample Nos. 31 and 32, in which the conductive paste for outer electrodes was baked under the same temperature condition, had the same average Ag grain size. Furthermore, the samples of Sample Nos. 33 and 34, in which the conductive paste for outer electrodes was baked under the same temperature condition, had the same average Ag grain size.

TABLE 3

| Sample No. | Average Ag grain size (μm) | MTTF (hr) |
|---|---|---|
| 32 | 12 | 801 |
| *34 | 3.0 | 707 |

Subsequently, the samples of Sample Nos. 31 and 33 were left to stand in an environment of 220° C. for 48 hours, and then, by the method explained in Example 1, a section for observation of the substantially central part of the outer electrode was obtained for each sample. The section for observation was analyzed by wavelength dispersive X-ray spectrometry (WDX analysis). The analysis results are shown in FIG. 6.

Figure 6:
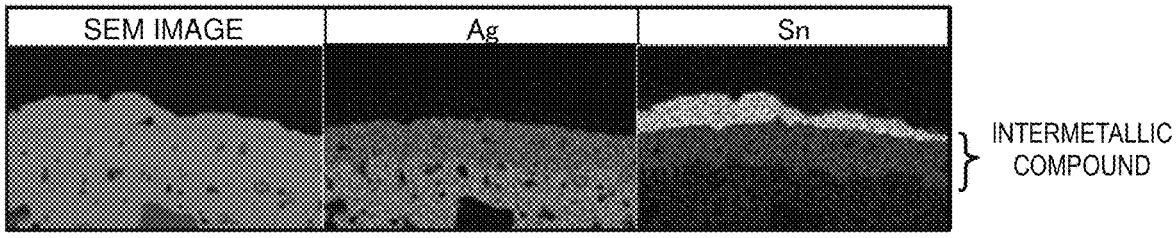
FIG. 6 shows results of analysis by wavelength dispersive X-ray spectrometry of sections for observation of samples of Sample Nos. 31 and 33.
Figure 6:
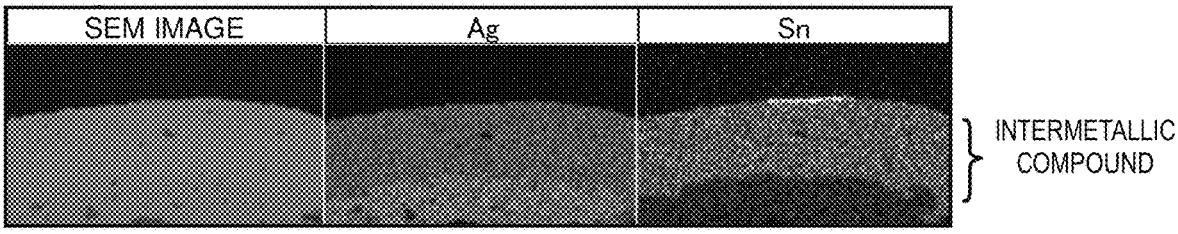

As shown in FIG. 6, in the sample of Sample No. 33 in which the average grain size of Ag grains contained in the outer electrode is 3 μm and which does not satisfy the requirement of the present disclosure, diffusion of Sn into Ag causes a marked formation of an intermetallic compound of Sn and Ag. On the other hand, in the sample of Sample No. 31 in which the average grain size of Ag grains contained in the outer electrode is 12 μm and which satisfies the requirement of the present disclosure, although an intermetallic compound of Sn and Ag is formed, the formation of the intermetallic compound is suppressed in comparison with the sample of Sample No. 33.

In general, metal diffusion predominantly occurs in grain boundaries in the low-temperature region. Therefore, by increasing the grain size of Ag grains so that the grain boundaries of Ag grains are reduced, metal diffusion can be suppressed, and the formation an intermetallic compound can be suppressed. Thereby, it is possible to improve the resistance to erosion of solder and the long-term reliability in the high-temperature environment of the coil component.

Next, 20 test pieces of each of the samples of Sample Nos. 32 and 34 were mounted by soldering on a substrate having lands, and a direct current of 4.1 A was applied between outer electrodes in the environment of 175° C. In this test, the current was applied such that the surface temperature of each test piece rose by 15° C. The time from the start of current application until the occurrence of disconnection between the outer electrodes was measured. In this test, disconnection was defined to have occurred when the insulation resistance between the outer electrodes exceeded 2Ω.

Regarding 20 test pieces of each of the samples of Sample Nos. 32 and 34, the time until the occurrence of disconnection was measured, and the average time was obtained as the mean time to failure (MTTF). The obtained mean time to failure is shown in Table 3.

As shown in Table 3, in the sample of Sample No. 32 in which the average grain size of Ag grains contained in the outer electrode is 12 μm and which satisfies the requirement of the present disclosure, the mean time to failure is about 13% longer than that of the sample of Sample No. 34 in which the average Ag grain size of Ag grains contained in the outer electrode is 3 μm and which does not satisfy the requirement of the present disclosure.

That is, by increasing the average grain size of Ag grains contained in the Ag-containing layer of the outer electrode, as described above, the formation an intermetallic compound can be suppressed, and the mean time to failure can be lengthened.

In the embodiments described above, the coil conductor 2 is disposed inside the device main body 1. However, the coil conductor 2 may be disposed on a surface of the device main body 1.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a device main body composed of an insulator;

a coil conductor which is disposed inside or on a surface of the device main body; and an outer electrode which is disposed on a surface of the device main body and electrically connected to the coil conductor, wherein the outer electrode includes a Ag-containing layer containing Ag grains with an average grain size of 4.2 to 15 μm, and wherein the Ag-containing layer has a pore area ratio of 8.3% or less.

2. The coil component according to claim 1, wherein the ratio of grain boundary length to area of the Ag grain contained in the Ag-containing layer is 1.1 or less.

3. The coil component according to claim 1, wherein the outer electrode further includes a plating layer disposed on the Ag-containing layer, and the plating layer has a thickness of 3.6 to 20 μm.

4. The coil component according to claim 3, wherein the plating layer includes a Ni layer containing Ni and a Sn layer containing Sn and formed on the Ni layer, and the Ni layer has a thickness of 3 μm or more.

5. The coil component according to claim 1, wherein the device main body is a multilayer body in which the insulator includes a plurality of insulating layers that are stacked, and the coil conductor is configured to include planar conductors disposed on the insulating layers, and an interlayer conductor that joins the planar conductors disposed on different insulating layers.

6. The coil component according to claim 5, wherein the insulating layers include a magnetic material layer mainly composed of ferrite and a glass-ceramic layer, and the coil conductor is disposed inside the glass-ceramic layer.

7. The coil component according to claim 1, wherein the Ag-containing layer contains 0.5% to 2% by weight of a glass phase containing at least one of Bi, Si, Zn, and B.

8. The coil component according to claim 2, wherein the outer electrode further includes a plating layer disposed on the Ag-containing layer, and the plating layer has a thickness of 3.6 to 20 μm.

9. The coil component according to claim 2, wherein the device main body is a multilayer body in which the insulator includes a plurality of insulating layers that are stacked, and the coil conductor is configured to include planar conductors disposed on the insulating layers, and an interlayer conductor that joins the planar conductors disposed on different insulating layers.

10. The coil component according to claim 3, wherein the device main body is a multilayer body in which the insulator includes a plurality of insulating layers that are stacked, and the coil conductor is configured to include planar conductors disposed on the insulating layers, and an interlayer conductor that joins the planar conductors disposed on different insulating layers.

11. The coil component according to claim 4, wherein the device main body is a multilayer body in which the insulator includes a plurality of insulating layers that are stacked, and the coil conductor is configured to include planar conductors disposed on the insulating layers, and an interlayer conductor that joins the planar conductors disposed on different insulating layers.

12. The coil component according to claim 2, wherein the Ag-containing layer contains 0.5% to 2% by weight of a glass phase containing at least one of Bi, Si, Zn, and B.

13. The coil component according to claim 3, wherein the Ag-containing layer contains 0.5% to 2% by weight of a glass phase containing at least one of Bi, Si, Zn, and B.

14. The coil component according to claim 4, wherein the Ag-containing layer contains 0.5% to 2% by weight of a glass phase containing at least one of Bi, Si, Zn, and B.

15. The coil component according to claim 5, wherein the Ag-containing layer contains 0.5% to 2% by weight of a glass phase containing at least one of Bi, Si, Zn, and B.

* * * * *